US006389388B1

(12) United States Patent
Lin

(10) Patent No.: US 6,389,388 B1
(45) **Date of Patent: *May 14, 2002**

(54) ENCODING A SPEECH SIGNAL USING CODE EXCITED LINEAR PREDICTION USING A PLURALITY OF CODEBOOKS

(75) Inventor: Daniel Lin, Montville, NJ (US)

(73) Assignee: InterDigital Technology Corporation, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/711,252

(22) Filed: Nov. 13, 2000

Related U.S. Application Data

(63) Continuation of application No. 08/734,356, filed on Oct. 21, 1996, now Pat. No. 6,240,382, which is a continuation of application No. 08/166,223, filed on Dec. 14, 1993, now Pat. No. 5,621,852.

(51) Int. Cl.[7] ..... G10L 19/04

(52) U.S. Cl. ..... 704/219; 704/220; 704/221; 704/222

(58) Field of Search ..... 704/219, 220, 704/221, 222, 223

(56) References Cited

U.S. PATENT DOCUMENTS

| | | | | |
|---|---|---|---|---|
| 4,220,819 A | | 9/1980 | Atal | 704/219 |
| 4,797,925 A | | 1/1989 | Lin | 704/223 |
| 4,817,157 A | | 3/1989 | Gerson | 704/230 |
| 5,271,089 A | | 12/1993 | Ozawa | 704/222 |
| 5,274,741 A | | 12/1993 | Taniguchi et al. | 704/222 |
| 5,353,373 A | | 10/1994 | Drogo de Iacouo et al. | 704/223 |
| 5,371,853 A | * | 12/1994 | Kao et al. | 704/223 |
| 5,451,951 A | | 9/1995 | Elliot et al. | 341/155 |

(List continued on next page.)

OTHER PUBLICATIONS

Moncet and Rabal, "Codeword Selection for CELP Coders", INRS—Telecommunications Technical Report, No. 87–35 (Jul. 1987), pp. 1–22.

Davidson and Gersho, "Complexity Reduction Methods for Vector Excitation Coding", IEEE–IECEI–ASJ International Conference on Acoustics, Speech and Signal Processing, vol. 4, Apr. 7, 1986, p. 3055.

Atal, "Predictive Coding at Low Bit Rates", IEEE Transactions on Communcations, vol. COM–30, No. 4 (Apr. 1982), p. 600.

Trancoso and Atat, "Efficient Procedures for Finding the Optimum Innovation Sequence in Stochastic Coders", IEEE International Conference on Acoustics, Speech and Signal Processing, vol. 4, Apr. 7, 1986, p. 2375.

Schroder et al., "Stochastic Coding at Very Low Bit Rates, The Importance of Speech Perception", Speech Communication 4 (1985), North Holland, p. 155.

Schroder et al., "Code Excited Linear Prediction (CELP) High Quality Speech At Very Low Bit Rates", IEEE 1985, p. 937.

(List continued on next page.)

*Primary Examiner*—Marsha D. Banks-Harold
*Assistant Examiner*—Susan McFadden
(74) *Attorney, Agent, or Firm*—Volpe & Koenig, P.C.

(57) ABSTRACT

A speech signal is encoded using code excited linear prediction for use in transmitting the speech signal to a receiver. The speech signal is sampled. A current sample of the speech signal is predicted based on in part a previous sample. An innovation sequence is determined based on in part a prediction error between the predicted current sample and the current sample of the speech signal. A code from each of a plurality of codebooks is selected. A combination of the selected codes is the determined innovation sequence. An index of the selected codes is identified and transmitted to the receiver. The transmitted index enables reconstruction of the speech signal at the receiver.

21 Claims, 6 Drawing Sheets

U.S. PATENT DOCUMENTS

| | | | | | |
|---|---|---|---|---|---|
| 5,621,852 | A | | 4/1997 | Lin | 704/219 |
| 5,657,418 | A | * | 8/1997 | Gerson et al. | 704/207 |
| 5,787,390 | A | * | 7/1998 | Quinquis et al. | 704/219 |
| 5,845,244 | A | * | 12/1998 | Proust | 704/220 |
| 6,148,282 | A | * | 11/2000 | Paksoy et al. | 704/219 |
| 6,161,086 | A | * | 12/2000 | Mukherjee et al. | 704/207 |
| 6,240,382 | B1 | * | 5/2001 | Lin | 704/219 |

OTHER PUBLICATIONS

Schroder, "Linear Predictive Coding of Speech: Review and Current Directions", IEEE Communications Magazine, vol. 23, No. 8, Aug. 1985, p. 54.

Miyano et al., "Improved 4.87 Kbls CELP Coding Using Two–Stage Vector Quantization with Multiple Candidates (LCELP)", ICASSP 1992: Acoustics Speech and Signal Processing Cone, Sep. 1992, pp. 321–324.

Casaju's Quir'os et al., "Analysis and Quantization Procedures for a Real–Time Implementation of a 4.8 kbls CELP Coder", ICASSP 1990: Acoustics, Speech and Signal Processing Cone, Feb. 1990, pp. 609–612.

* cited by examiner

10
INPUT SPEECH SAMPLES
12
PERCEPTUAL WEIGHTING
14
16
WEIGHTED SYNTHESIS FILTER
ZERO INPUT
18
ADAPTIVE CODEBOOK ANALYSIS
20
22
WEIGHTED SYNTHESIS FILTER
24
TERNARY CODEBOOK ANALYSIS
26
LPC ANALYSIS
28
LSP QUANTIZATION
CODE INDEX AND GAIN
PITCH LAG AND GAIN
LSP INDEX
30
COMMUNICATION CHANNEL
31

BINARY CODEBOOK 1
1
2
3
I
BINARY CODEBOOK 2
1
2
3
J
LINEAR FILTER
50
LINEAR FILTER
68
CORRELATION
56
CORRELATION
52
CORRELATION
72
X TARGET VECTOR
X TARGET VECTOR
ENERGY-SUM OF SQUARES
54
ENERGY-SUM OF SQUARES
70
2
58
60
PEAK SELECTION
62
CODEBOOK INDEX i
CODEBOOK INDEX j
SQUARE FUNCTION
64
66

ENCODING A SPEECH SIGNAL USING CODE EXCITED LINEAR PREDICTION USING A PLURALITY OF CODEBOOKS

CROSS REFERENCES TO RELATED APPLICATIONS

This application is a continuation of U.S. application Ser. No. 08/734,356, filed Oct. 21, 1996, now U.S. Pat. No. 6,240,382 which is a continuation of U.S. application Ser. No. 08/166,223, filed Dec. 14, 1993, now U.S. Pat. No. 5,621,852.

FIELD OF THE INVENTION

This invention relates to digital speech encoders using code excited linear prediction coding, or CELP. More particularly, this invention relates a method and apparatus for efficiently selecting a desired codevector used to reproduce an encoded speech segment at the decoder.

BACKGROUND OF THE INVENTION

Direct quantization of analog speech signals is too inefficient for effective bandwidth utilization. A technique known as linear predictive coding, or LPC, which takes advantage of speech signal redundancies, requires much fewer bits to transmit or store speech signals. Originally speech signals are produced as a result of acoustical excitation of the vocal tract. While the vocal cords produce the acoustical excitation, the vocal tract (e.g. mouth, tongue and lips) acts as a time varying filter of the vocal excitation. Thus, speech signals can be efficiently represented as a quasi-periodic excitation signal plus the time varying parameters of a digital filter. In addition, the periodic nature of the vocal excitation can further be represented by a linear filter excited by a noise-like Gaussian sequence. Thus, in CELP, a first long delay predictor corresponds to the pitch periodicity of the human vocal cords, and a second short delay predictor corresponds to the filtering action of the human vocal tract CELP reproduces the individual speaker's voice by processing the input speech to determine the desired excitation sequence and time varying digital filter parameters. At the encoder, a prediction filter forms an estimate for the current sample of the input signal based on the past reconstructed values of the signal at the receiver decoder, i.e. the transmitter encoder predicts the value that the receiver decoder will reconstruct. The difference between the current value and predicted value of the input signal is the prediction error. For each frame of speech, the prediction residual and filter parameters are communicated to the receiver. The prediction residual or prediction error is also known as the innovation sequence and is used at the receiver as the excitation input to the prediction filters to reconstruct the speech signal. Each sample of the reconstructed speech signal is produced by adding the received signal to the predicted estimate of the present sample. For each successive speech frame, the innovation sequence and updated filter parameters are communicated to the receiver decoder.

The innovation sequence is typically encoded using codebook encoding. In codebook encoding, each possible innovation sequence is stored as an entry in a codebook and each is represented by an index. The transmitter and receiver both have the same codebook contents. To communicate an given innovation sequence, the index for that innovation sequence in the transmitter codebook is transmitted to the receiver. At the receiver, the received index is used to look up the desired innovation sequence in the receiver codebook for use as the excitation sequence to the time varying digital filters.

The task of the CELP encoder is to generate the time varying filter coefficients and the innovation sequence in real time. The difficulty of rapidly selecting the best innovation sequence from a set of possible innovation sequences for each frame of speech is an impediment to commercial achievement of real time CELP based systems, such as cellular telephone, voice mail and the like.

Both random and deterministic codebooks are known. Random codebooks are used because the probability density function of the prediction error samples has been shown to be nearly white Gaussian random noise. However, random codebooks present a heavy computational burden to select an innovation sequence from the codebook at the encoder since the codebook must be exhaustively searched.

To select an innovation sequence from the codebook of stored innovation sequences, a given fidelity criterion is used. Each innovation sequence is filtered through time varying linear recursive filters to reconstruct (predict) the speech frame as it would be reconstructed at the receiver. The predicted speech frame using the candidate innovation sequence is compared with the desired target speech frame (filtered through a perceptual weighting filter) and the fidelity criterion is calculated. The process is repeated for each stored innovation sequence. The innovation sequence that maximizes the fidelity criterion function is selected as the optimum innovation sequence, and an index representing the selected optimum sequence is sent to the receiver, along with other filter parameters.

At the receiver, the index is used to access the selected innovation sequence, and, in conjunction with the other filter parameters, to reconstruct the desired speech.

The central problem is how to select an optimum innovation sequence from the codebook at the encoder within the constraints of real time speech encoding and acceptable transmission delay. In a random codebook, the innovation sequences are independently generated random white Gaussian sequences. The computational burden of performing an exhaustive search of all the innovation sequences in the random code book is extremely high because each innovation sequence must be passed through the prediction filters.

One prior art solution to the problem of selecting an innovation-sequence is found in U.S. Pat. No. 4,797,925 in which the adjacent codebook entries have a subset of elements in common. In particular, each succeeding code sequence may be generated from the previous code sequence by removing one or more elements from the beginning of the previous sequence and adding one or more elements to the end of the previous sequence. The filter response to each succeeding code sequence is then generated from the filter response to the preceding code sequence by subtracting the filter response to the first samples and appending the filter response to the added samples. Such overlapping codebook structure permits accelerated calculation of the fidelity criterion.

Another prior art solution to the problem of rapidly selecting an optimum innovation sequence is found in U.S. Pat. No. 4,817,157 in which the codebook of excitation vectors is derived from a set of M basis vectors which are used to generate a set of $2^M$ codebook excitation code vectors. The entire codebook of $2^M$ possible excitation vectors is searched using the knowledge of how the code vectors are generated from. the basis vectors, without having to generate and evaluate each of the individual code vectors.

SUMMARY OF THE INVENTION

The present invention is embodied in a speech communication system using a ternary innovation codebook which is formed by the sum of two binary codebooks. The ternary codebook has code sequences $C_k$, constructed from the set of values, {−1,0,1}. To form the ternary codebook, one binary codebook has the values {0,1}, and the other binary codebook has the values {−1,0}. The sum of one binary codevector from each binary codebook forms a ternary codevector. The codebook structure of the present invention, permits several efficient search procedures and reduced storage. For example, a ternary codebook of 256 sequences may be formed from two binary codebooks of 16 each (32 total). Each of the 256 ternary sequences is formed as the sum of 1 of 16 binary sequences from the first binary codebook and 1 of 16 binary sequences from the second binary codebook.

More important than reduced storage, the binary codebooks may be efficiently searched for optimum values of a given fidelity criterion function. The computational burden of searching for optimum sequences is eased because there are fewer sequences (32 verses 256 in the above example) to filter and correlate in computing the fidelity criterion function, even for an exhaustive search of all combinations of the two binary codebooks. Since the processing is linear, the principle of superposition may be used to obtain the result of ternary codevector processing by adding the results of binary codevector processing. In addition, as alternate embodiments to an exhaustive search of the binary codebooks, two sub-optimum searches are possible.

In the first sub-optimum search, each binary codebook is independently searched for a subset of optimum binary codevectors, say for example, the 5 best binary codevectors of each codebook of 16 codevectors is found, forming two optimum codevector subsets of 5 codevectors each. Then an exhaustive search of all combinations (25 in this example) of the optimum codevector subsets is performed. For the subset exhaustive search calculation, the filtering and auto-correlation terms from the first calculation of the optimum codevector subsets are available for reuse in the subsequent exhaustive search. In addition, the number of cross-correlation calculations, also 25, is substantially reduced compared to the number of cross-correlation calculations required in an exhaustive search of the full codebook sets, i.e. 256.

In a second sub-optimum search, the one best binary codevector is found from the set consisting of both the first and second binary codebooks. Then an exhaustive search is performed using the one best binary codevector in combination with each of the codevectors from the other binary codebook which did not contain the one best binary codevector. In the second sub-optimum search, the filtering and auto-correlation terms from the first calculation of the fidelity criterion function for the one best binary codevector are available for reuse in the subsequent exhaustive search of the other binary codebook. In addition, the number of cross-correlation calculations is further reduced to 16, which is less than the number of cross-correlation calculations required in an exhaustive search of the full codebook sets or using the optimum subsets.

DETAILED DESCRIPTION

CELP Encoding

Figure 1:
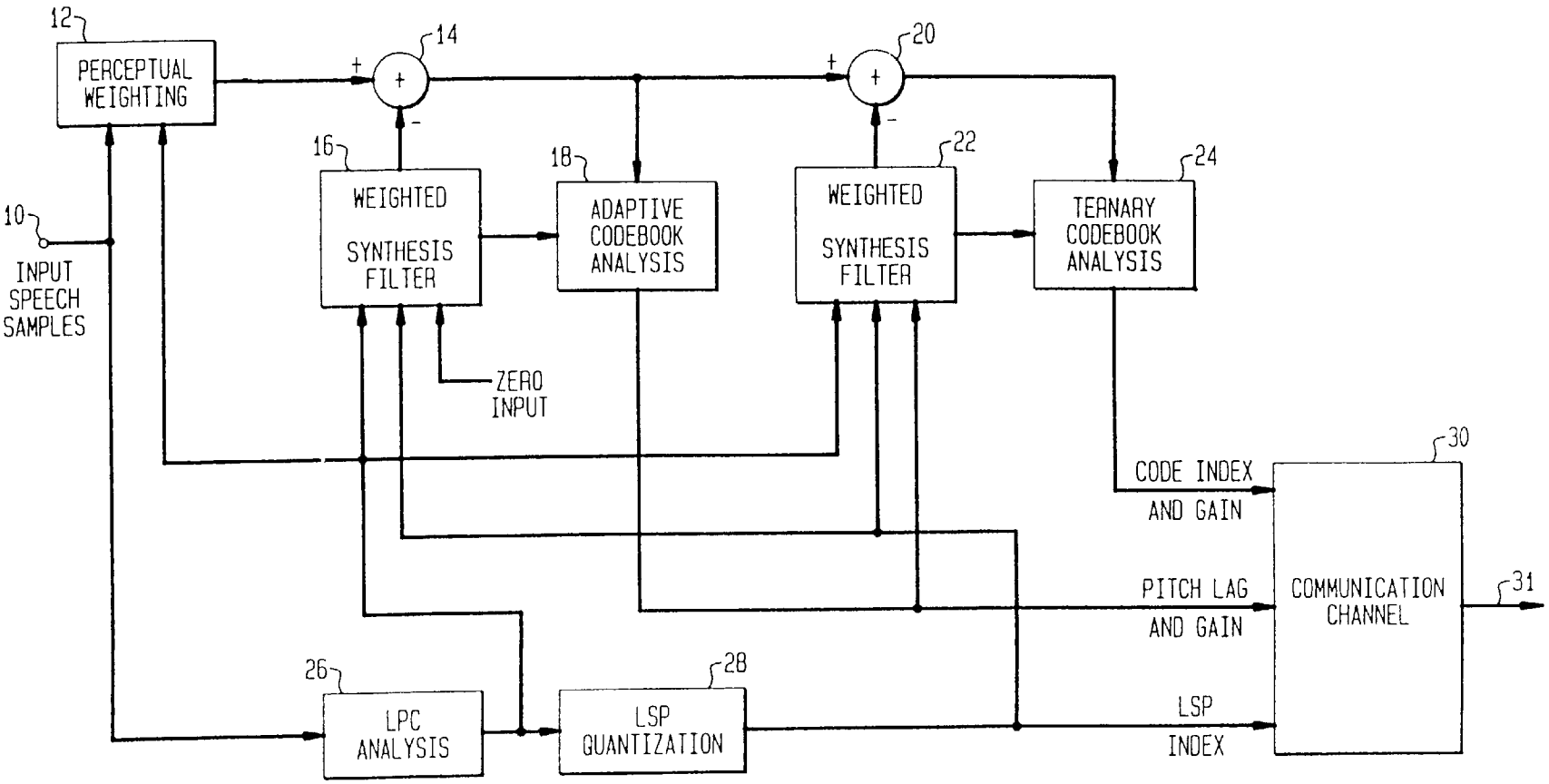
FIG. 1 is a diagram of a CELP encoder utilizing a ternary codebook in accordance with the present invention.

The CELP encoder of FIG. 1 includes an input terminal 10 for receiving input speech samples which have been converted to digital form. The CELP encoder represents the input speech samples as digital parameters comprising an LSP index, a pitch lag and gain, and a code index and gain, for digital multiplexing by transmitter 30 on communication channel 31.

LSP Index

As indicated above, speech signals are produced as a result of acoustical excitation of the vocal tract. The input speech samples received on terminal 10 are processed in accordance with known techniques of LPC analysis 26, and are then quantized by a line spectral pair (LSP) quantization circuit 28 into a conventional LSP index.

Pitch Lag and Gain

Pitch lag and gain are derived from the input speech using a weighted synthesis filter 16, and an adaptive codebook analysis 18. The parameters of pitch lag and gain are made adaptive to the voice of the speaker, as is known in the art. The prediction error between the input speech samples at the output of the perceptual weighting filter 12, and predicted reconstructed speech samples from a weighted synthesis filter 16 is available at the output of adder 14. The perceptual weighting filter 12 attenuates those frequencies where the error is perceptually more important. The role of the weighting filter is to concentrate the coding noise in the formant regions where it is effectively masked by the speech signal. By doing so, the noise at other frequencies can be lowered to reduce the overall perceived noise. Weighted synthesis filter 16 represents the combined effect of the decoder synthesis filter and the perceptual weighting filter 12. Also, in order to set the proper initial conditions at the subframe boundary, a zero input is provided to weighted synthesis filter 16. The adaptive codebook analysis 18 performs predictive analysis by selecting a pitch lag and gain which minimizes the instantaneous energy of the mean squared prediction error.

Innovation Code Index and Gain

The innovation code index and gain is also made adaptive to the voice of the speaker using a second weighted synthesis filter 22, and a ternary codebook analysis 24, containing an encoder ternary codebook of the present invention. The prediction error between the input speech samples at the output of the adder 14, and predicted reconstructed speech samples from a second weighted synthesis filter 22 is available at the output of adder 20. Weighted synthesis filter 22 represents the combined effect of the decoder synthesis filter and the perceptual weighting filter 12, and also subtracts the effect of adaptive pitch lag and gain introduced by weighted synthesis filter 16 to the output of adder 14.

The ternary codebook analysis 18 performs predictive analysis by selecting an innovation sequence which maximizes a given fidelity criterion function. The ternary codebook structure is readily understood from a discussion of CELP decoding.

CELP Decoding

Figure 2:
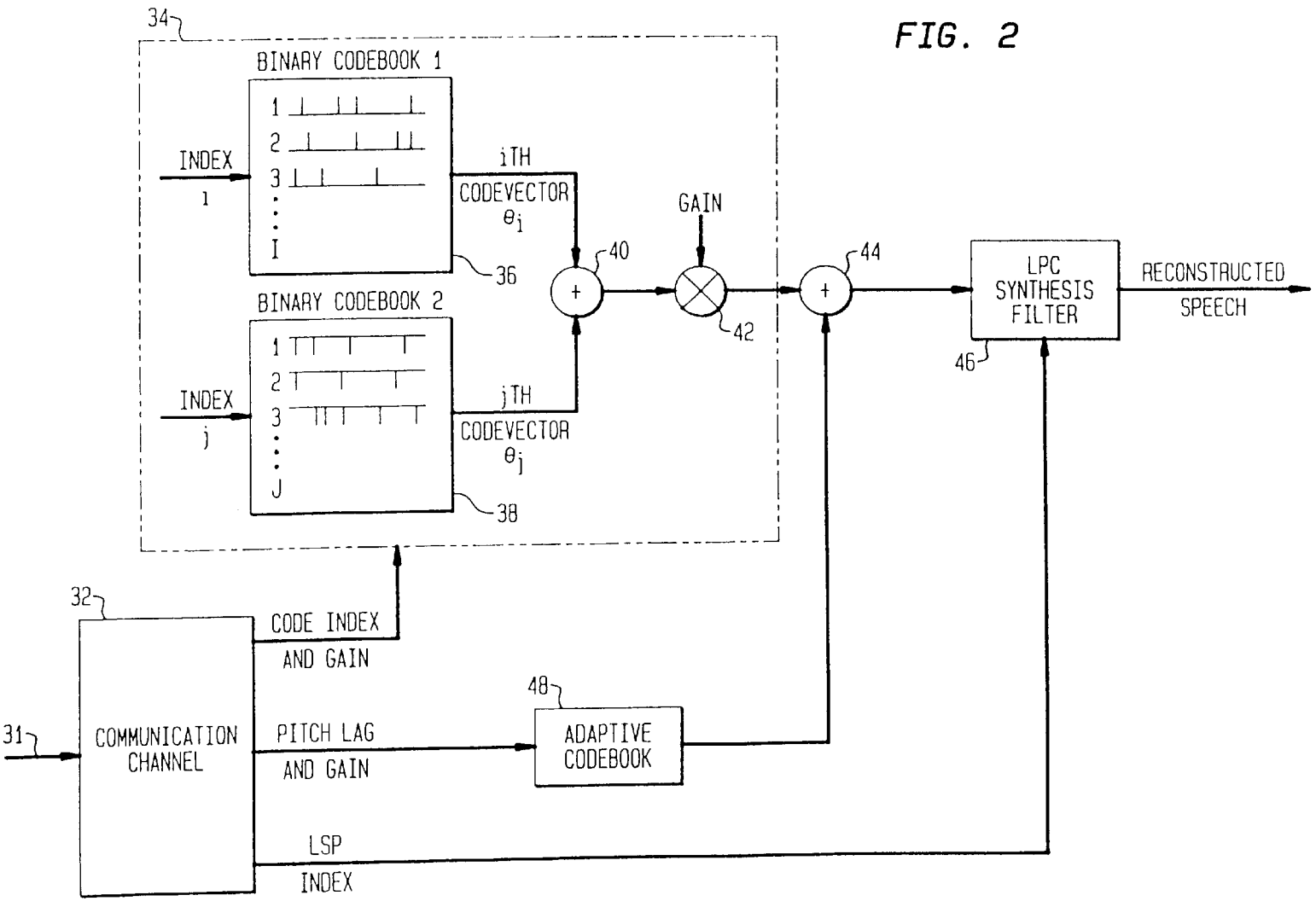
FIG. 2 is a block diagram of a CELP decoder utilizing a ternary codebook in accordance with the present invention.

A CELP system decoder is shown in FIG. 2. A digital demultiplexer 32 is coupled to a communication channel 31.

The received innovation code index (index i and index j), and associated gain is input to ternary decoder codebook 34. The ternary decoder codebook 34 is comprised of a first binary codebook 36, and a second binary codebook 38. The output of the first and second binary codebooks are added together in adder 40 to form a ternary codebook output, which is scaled by the received signed gain in multiplier 42. In general, any two digital codebooks may be added to form a third digital codebook by combining respective codevectors, such as a summation operation.

Figure 6A:
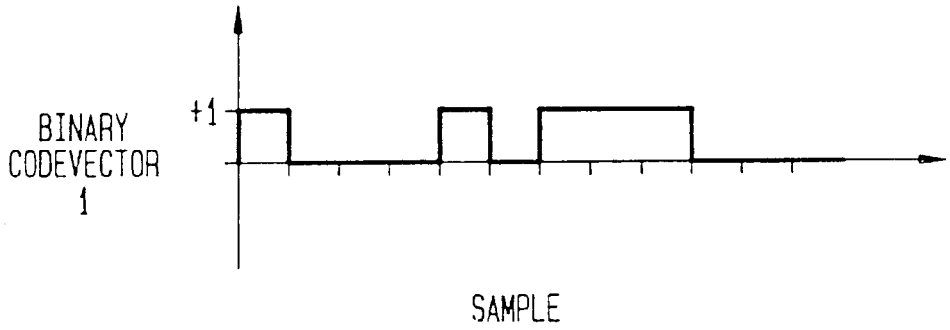
FIGS. 6A, 6B, and 6C is a graphical representations of a first binary codevector, a second binary codevector, and a ternary codevector, respectively.
Figure 6B:
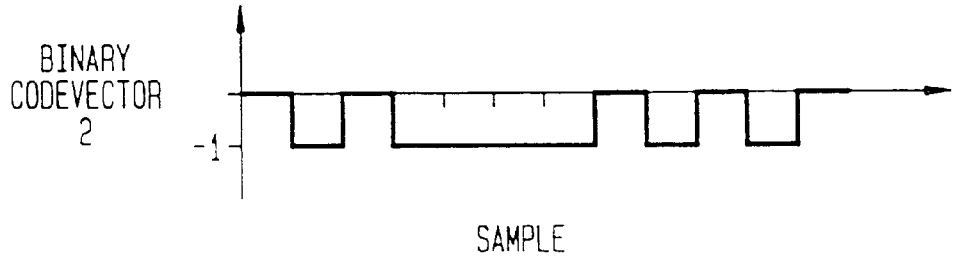
Figure 6C:
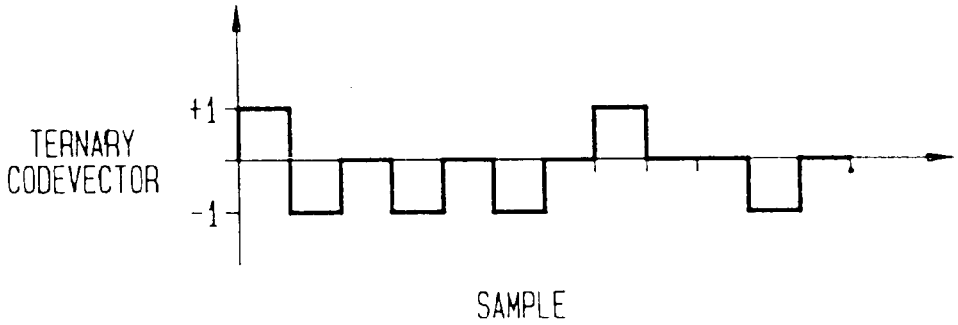

To illustrate how a ternary codevector is formed from two binary codevectors, reference is made to FIGS. 6A, 6B and 6C. A first binary codevector is shown in FIG. 6A consisting of values {0,1}. A second binary codevector is shown in FIG. 6B consisting of values {−1,0}. By signed addition in adder 40 of FIG. 2, the two binary codevectors form a ternary codevector, as illustrated in FIG. 6C.

The output of the ternary decoder codebook 34 in FIG. 2 is the desired innovation sequence or the excitation input to a CELP system. In particular, the innovation sequence from ternary decoder codebook 34 is combined in adder 44 with the output of the adaptive codebook 48 and applied to LPC synthesis filter 46. The result at the output of LPC synthesis filter 46 is the reconstructed speech. As a specific example, if each speech frame is 4 milliseconds, and the sampling rate is 8 Mhz, then each innovation sequence, or codevector, is 32 samples long.

Optimum Innovation Sequence Selection

Figure 3:
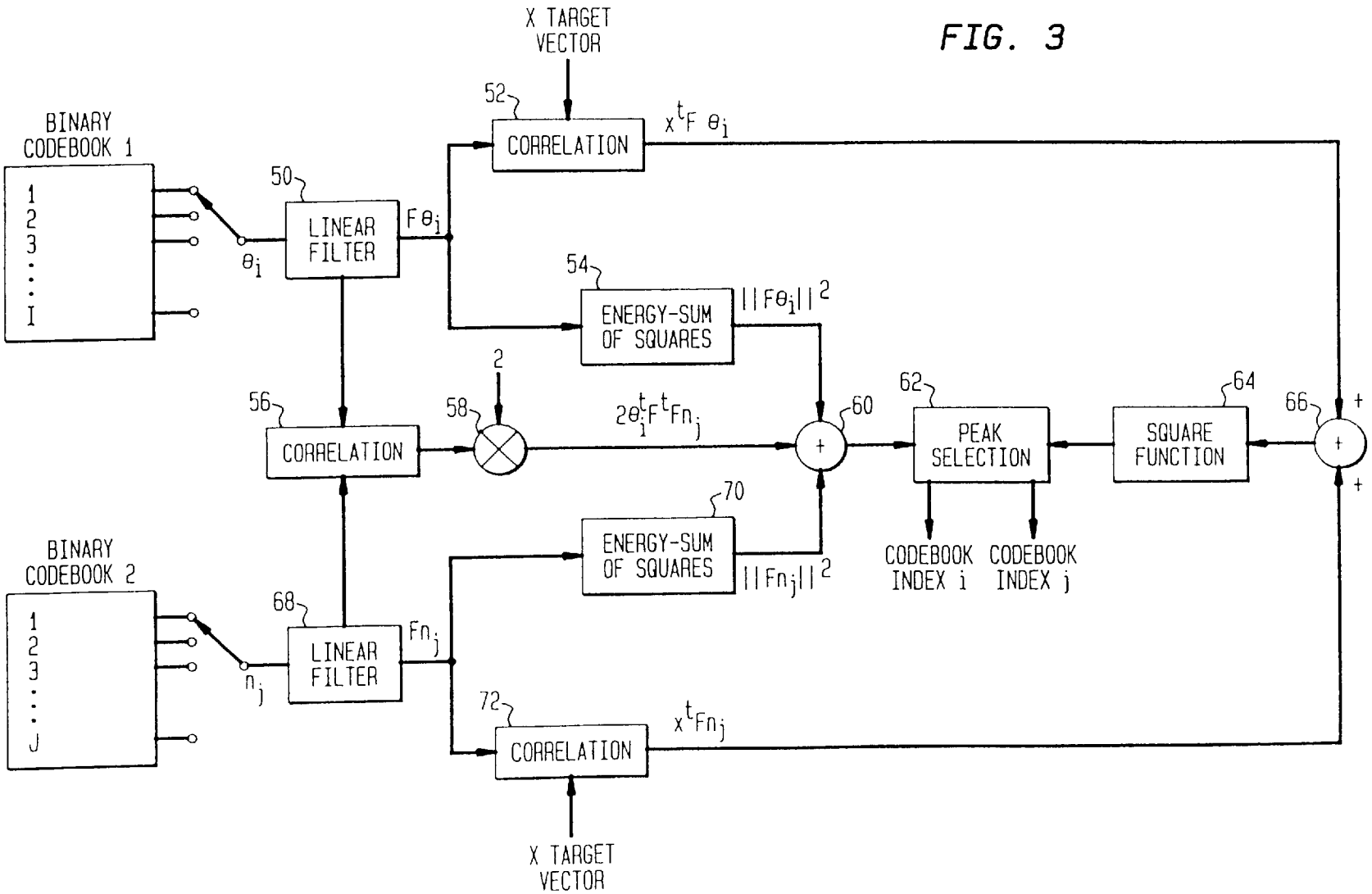
FIG. 3 is a flow diagram of an exhaustive search process for finding an optimum codevector in accordance with the present invention.

The ternary codebook analysis 24 of FIG. 1 is illustrated in further detail by the process flow diagram of FIG. 3. In code excited linear prediction coding, the optimum codevector is found by maximizing the fidelity criterion function, $$\max_k \frac{(x^t F c_k)^2}{\|F c_k\|^2} \qquad \text{(equation 1)}$$

where $x^t$ is the target vector representing the input speech sample, F is an N×N matrix with the term in the n th row and the i th column given by $f_{n-i}$, and $C_k$ is the k th codevector in the innovation codebook. Also, $\| \|^2$ indicates the sum of the squares of the vector components, and is essentially a measure of signal energy content. The truncated impulse response $f_n$, n=1,2. . . N, represents the combined effects of the decoder synthesis filter and the perceptual weighting filter. The computational burden of the CELP encoder comes from the evaluation of the filtered term $Fc_k$ and the cross-correlation, auto-correlation terms in the fidelity criterion function.

Let $C_k=\theta_i=72_j$,

K=0, 1, . . . K−1 i=0, 1, . . . I−1 j=0, 1, . . . J−1

$\text{Log}_2 K=\text{Log}_2 I+\text{Log}_2 J$, where $\theta_i$, $\eta_j$ are codevectors from the two binary codebooks, the fidelity criterion function for the codebook search becomes, $$\Psi(i, j) = \frac{(x^t F\theta_i + x^t F\eta_j)^2}{\theta_i^t F^t F\theta_i + 2\theta_i^t F^t F\eta_j + \eta_j^t F^t F\eta_j} \qquad \text{(equation 2)}$$

Search Procedures

There are several ways in which the fidelity criterion function Ψ(i,j) may be evaluated.

1. Exhaustive Search.

Finding the maximum Ψ(i, j) involves the calculation of $F\theta_i$, $F\eta_j$ and $\theta_i^t F^t F\eta_j$, which has I and J filtering and the IJ cross-correlation of $x^t F\theta_i$, $x_t F\eta_j$ and $\|F\theta_i\|^2$, $\|F\eta_j\|^2$, which has I+J cross-correlation and I+J auto-correlation terms.

FIG. 3 illustrates an exhaustive search process for the optimum innovation sequence. All combinations of binary codevectors in binary codebooks 1 and 2 are computed for the fidelity criterion function ⊥T(i, j). The peak fidelity criterion function ΨT(i, j) is, selected at step 62, thereby identifying the desired codebook index i and codebook index j.

Binary codebook 1 is selectively coupled to linear filter 50. The output of linear filter 50 is coupled to correlation step 52, which provides a correlation calculation with the target speech vector X, the input speech samples filtered in a perceptual weighting filter. Binary codebook 2 is selectively coupled to linear filter 68. The output of linear filter 68 is coupled to correlation step 72, which provides a correlation calculation with the target speech vector X. The output of correlation step 52 is coupled to one input of adder 66. The output of correlation step 72 is coupled to the other input of adder 66. The output of adder 66 is coupled to a square function 64 which squares the output of the adder 66 to form a value equal to the numerator of the fidelity criterion Ψ(i, j) of equation 2. The linear filters 50 and 68 are each equivalent to the weighted synthesis filter 22 of FIG. 1 and are used only in the process of selecting optimum synthesis parameters. The decoder (FIG. 2) will use the normal synthesis filer.

The output of linear filter 50 is also coupled to a sum of the squares calculation step 54. The output of linear filter 68 is further coupled to a sum of the squares calculation step 70. The sum of the squares is a measure of signal energy content. The linear filter 50 and the linear filter 68 are also input to correlation step 56 to form a cross-correlation term between codebook 1 and codebook 2. The cross-correlation term output of correlation step 56 is multiplied by 2 in multiplier 58. Adder 60 combines the output of multiplier 58, the output of sum of the squares calculation step 54 plus the output of sum of the squares calculation step 70 to form a value equal to the demomimator of the fidelity criterion ΨT(i, j) of equation 2.

In operation, one of 16 codevectors of binary codebook 1 corresponding to a 4 bit codebook index i, and one of 16 codevectors of binary codebook 2 corresponding to a 4 bit codebook index j, is selected for evaluation in the fidelity criterion. The total number of searches is 16×16, or 256. Hoverer, the linear filtering steps 50, 68, the auto-correlation calculations 52, 72 and the sum of the squares calculation 54, 70 need only be performed 32 times (not 256 times), or once for each of 16 binary codevectors in two codebooks. The results of prior calculations are saved and reused, thereby reducing the time required to perform an exhaustive search. The number of cross-correlation calculations in correlation step 56 is equal to 256, the number of binary vector combinations searched.

The peak selection step 62 receives the numerator of equation 2 on one input and the denominator of equation 2 on the other input for each of the 256 searched combinations. Accordingly, the codebook index i and codebook index j corresponding to a peak of the fidelity criterion function Ψ(i, j) is identified. The ability to search the ternary codebook 34, which stores 256 ternary codevectors, by searching among only 32 binary codevectors, is based on the superposition property of linear filters.

2. Sub-Optimum Search I

Figure 4:
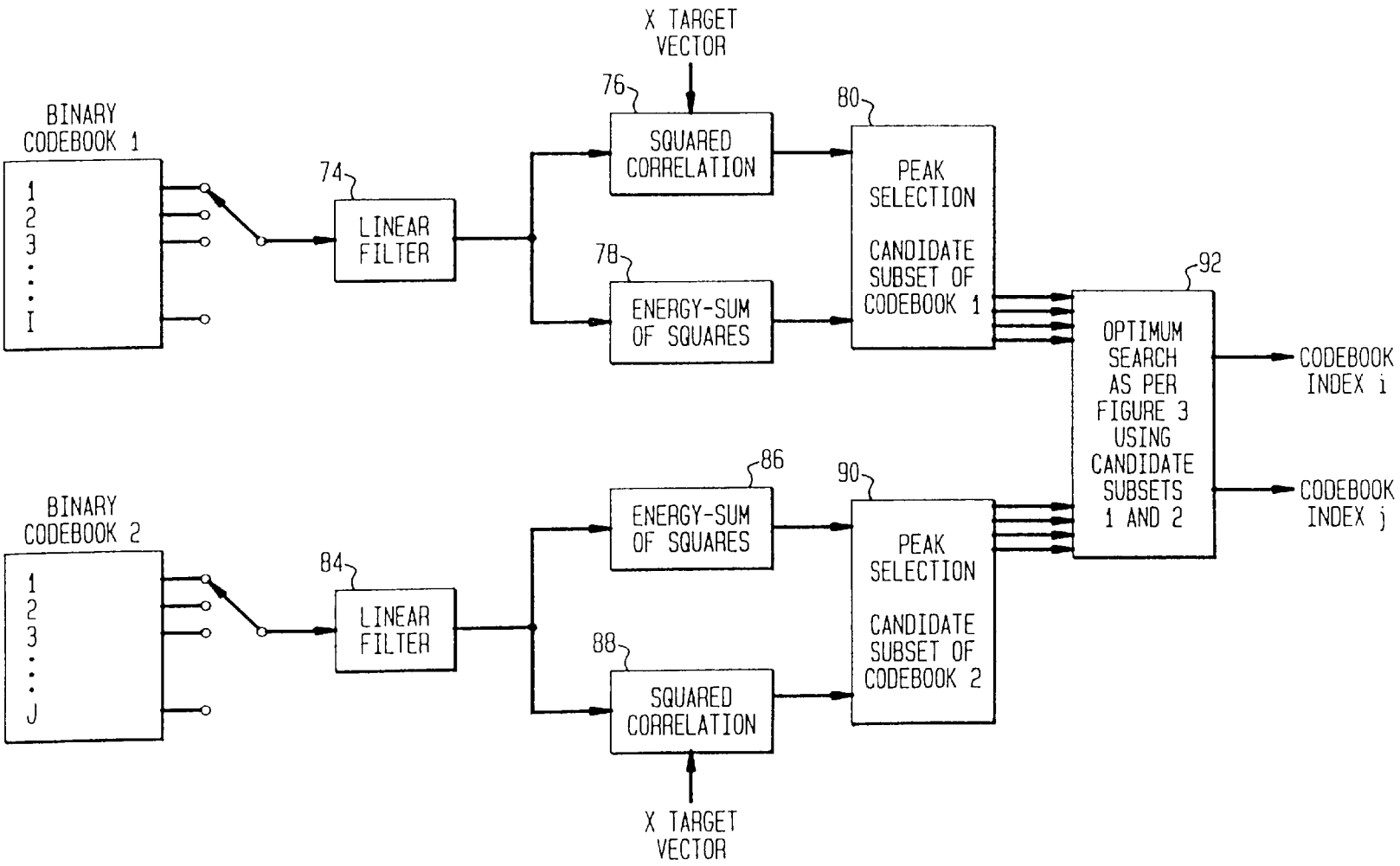
FIG. 4 is a flow diagram of a first sub-optimum search process for finding a codevector in accordance with the present invention.

FIG. 4 illustrates an alternative search process for the codebook index i and codebook index j corresponding to a desired codebook innovation sequence. This search involves the calculation of equation 1 for codebook 1 and codebook 2 individually as follows:

$$\frac{(x^t F\theta_i)^2}{\|F\theta_i\|^2} \text{ and } \frac{(x^t F\eta_j)^2}{\|F\eta_j\|^2} \qquad \text{(equation 3)}$$

To search all the codevectors in both codebooks individually, only 16 searches are needed, and no cross-correlation terms exist. A subset of codevectors (say 5) in each of the two binary codebooks are selected as the most likely candidates. The two subsets that maximizes the fidelity criterion functions above are then jointly searched to determine the optimum, as in the exhaustive search in FIG. 3. Thus, for a subset of 5 codevectors in each codebook, only 25 joint searches are needed to exhaustively search all subset combinations.

In FIG. 4, binary codebook 1 is selectively coupled to linear filter 74. The output of linear filter 74 is coupled to a squared correlation step 76, which provides a squared correlation calculation with the target speech vector X. The output of linear filter 74 is also coupled to a sum of the squares calculation step 78. The output of the squared correlation step 76, and the sum of the squares calculation step 78 is input to peak selection step 80 to select a candidate subset of codebook 1 vectors.

Binary codebook 2 is selectively coupled to linear filter 84. The output of linear filter 84 is coupled to a squared correlation step 86, which provides a squared correlation calculation with the target speech vector X. The output of linear filter 84 is also coupled to a sum of the squares calculation step 88. The output of the squared correlation step. 86, and the sum of the squares calculation step 88 is input to peak selection step 80 to select a candidate subset of codebook 2 vectors. In such manner a fidelity criterion function expressed by equation 3 is carried out in the process of FIG. 4.

After the candidate subsets are determined, an exhaustive search as illustrated in FIG. 3 is performed using the candidate subsets as the input codevectors. In the present example, 25 searches are needed for an exhaustive search of the candidate subsets, as compared to 256 searches for the full binary codebooks. In addition, filtering and auto-correlation terms from the first calculation of the optimum binary codevector subsets are available for reuse in the subsequent exhaustive search of the candidate subsets.

3. Sub-Optimum Search II

Figure 5:
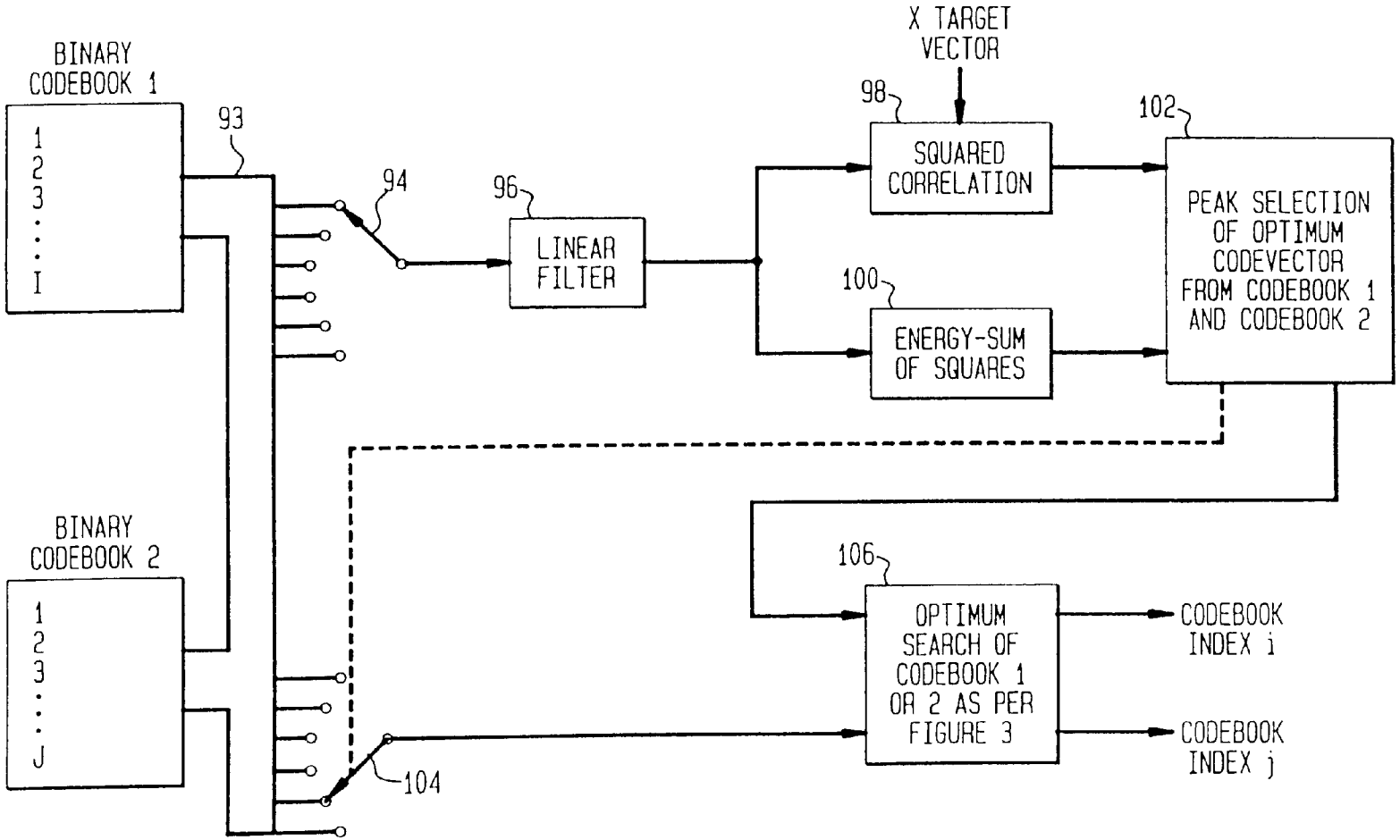
FIG. 5 is a flow diagram of a second sub-optimum search process for finding a codevector in accordance with the present invention.

FIG. 5 illustrates yet another alternative search process for the codebook index i and codebook index j corresponding to a desired codebook innovation sequence. This search evaluates each of the binary codevectors individually in both codebooks using the same fidelity criterion function as given in equation 3 to find the one binary codevector having the maximum value of the fidelity criterion function. The maximum binary codevector, which may be found in either codebook (binary codebook 1 or binary codebook 2), is then exhaustively searched in combination with each binary codevector in the otter binary codebook (binary codebook 2 or binary codebook 1), to maximize the fidelity criterion function $\Psi(i, j)$.

In FIG. 5, binary codebooks 1 and 2 are treated as a single set of binary codevectors, as schematically represented by a data bus 93 and selection switches 94 and 104.

That is, each binary codevector of binary codebook 1 and binary codebook 2 is selectively coupled to linear filter 96. The output of linear filter 96 is coupled to a squared correlation step 98, which provides a squared correlation calculation with the target speech vector X. The output of linear filter 96 is also coupled to a sum of the squares calculation step 100. The output of the squared correlation step 98, and the sum of the squares calculation step 100 is input to peak selection step 102 to select a single optimum codevector from codebook 1 and codebook 2. A total of 32 searches is required, and no cross-correlation terms are needed.

Having found the optimum binary codevector from codebook 1 and codebook 2, an exhaustive search for the optimum combination of binary codevectors 106 (as illustrated in FIG. 3) is performed using the single optimum codevector found as one set of the input codevectors. In addition, instead of exhaustively searching both codebooks, switch 104 under the control of the peak selection step 102, selects the codevectors from the binary codebook which does not contain the single optimum codevector found by peak selection step 102. In other words, if binary codebook 2 contains the optimum binary codevector, then switch 104 selects the set of binary codevectors from binary codebook 1 for the exhaustive search 106, and vice versa. In such manner, only 16 exhaustive searches need be performed. As before, filtering and auto-correlation terms from the first calculation of the optimum single optimum codevector from codebook 1 and codebook 2 are available for reuse in the subsequent exhaustive search step 106. The output of search step is the codebook index i and codebook index j representing the ternary innovation sequence for the current frame of speech.

Overlapping Codebook Structures

For any of the foregoing search strategies, the calculation of $F\theta_i$, $F\eta_j$ can be further accelerated by using an overlapping codebook structure as indicated in cited U.S. Pat. No. 4,797,925 to the present inventor. That is, the codebook structure has adjacent codevectors which have a subset of elements in common. An example of such structure is the following two codevectors:

$$\theta_L{}^t=(g_L, g_{L+1}, \ldots, g_{L+N-1})$$

$$\theta_{L+1}{}^t=(g_{L+1}, g_{L+2}, \ldots, g_{L+N})$$

Other overlapping structures in which the starting positions of the codevectors are shifted by more than one sample are also possible. With the overlapping structure, the filtering operation of $F\theta_i$ and $F\eta_j$ can be accomplished by a procedure using recursive endpoint correction in which the filter response to each succeeding code sequence is then generated from the filter response to the preceding code sequence by subtracting the filter response to the first sample $g_L$, and appending the filter response to the added sample $g_{L+N}$. In such manner, except for the first codevector, the filter response to each successive codevector can be calculated using only one additional sample.

What is claimed is:

1. A method for encoding a speech signal using code excited linear prediction for use in transmitting the speech signal to a receiver, the method comprising:

sampling the speech signal;

predicting a current sample of the speech signal based on in part a previous sample;

determining an innovation sequence based on in part a prediction error between the predicted current sample and the current sample of the speech signal, the determined innovation sequence being a ternary sequence;

selecting a code from each of a plurality of codebooks, a summation of the selected codes is the determined innovation sequence; and identifying and transmitting an index of the selected codes to the receiver; whereby the transmitted index enables reconstruction of the speech signal at the receiver.

2. The method of claim 1 wherein the plurality of codebook is two codebooks.

3. The method of claim 2 wherein the index comprises a first index representing the code of one of the two codebooks and a second index representing the code of another of the two codebooks.

4. The method of claim 2 further comprising adding the two selected codes as the selected odes summation.

5. The method of claim 2 wherein the selected codes are binary sequences.

6. The method of claim 2 wherein a possible number of determined innovation sequences is $2^M$ and the codes in each codebook numbers $2^{M/2}$ when M is an even integer.

7. The method of claim 2 wherein a possible number of determined innovation sequences numbers 256 and the codes in each codebook numbers 16.

8. A code excited linear prediction (CELP) encoder for use in encoding a speech signal for transmission to a receiver, the CELP encoder comprising:

an input configured to receive samples of a speech signal; and a ternary codebook analysis block for selecting an index of a code from each of a plurality of codebooks, a summation of the selected codes is a selected innovation sequence, the selected innovation sequence is a ternary sequence and is based on in part a prediction error between a predicted current sample and a current sample of the speech samples;

whereby the index is transmitted the receiver to enable reconstruction of the speech signal at the receiver.

9. The CELP encoder of claim 8 wherein the plurality of codebooks is two codebooks.

10. The CELP encoder of claim 9 wherein the index comprises a first index representing the code of one of the two codebooks and a second index representing the code of another of the two codebooks.

11. The CELP encoder of claim 9 further comprising an adder for adding the selected codes as the selected codes summation.

12. The CELP encoder of claim 9 wherein the selected codes are binary sequences.

13. The CELP encoder of claim 9 wherein a possible number of determined innovation sequences is $2^M$ and the codes in each codebook numbers $2^{M/2}$ when M is an even integer.

14. The CELP encoder of claim 9 wherein a possible number of determined innovation sequences is 256 and the codes in each codebook numbers 16.

15. A transmitter for use in transmitting an encoded speech signal to a receiver, the encoded speech signal encoded using code excited linear prediction, the transmitter comprising:

means for sampling a speech signal;

means for predicting a current sample of the speech signal based on in part a previous speech signal;

means for determining an innovation sequence based on in part a prediction error between the predicted current sample and a current sample of the speech signal, the innovation sequence being a ternary sequence;

means for selecting a code from each of a plurality of codebooks, a summation of the selected codes is the determined innovation sequence; and means for identifying and transmitting an index of the selected codes to the receiver; whereby the transmitted index enables reconstruction of the speech signal at the receiver.

16. The transmitter of claim 15 wherein the plurality of codebooks is two codebooks.

17. The transmitter of claim 16 wherein the index comprises a first index representing the code of one of the two codebooks and a second index representing the code of another of the two codebooks.

18. The transmitter of claim 16 further comprising means for adding the selected codes as the selected codes summation.

19. The transmitter of claim 16 wherein the selected codes are binary sequences.

20. The transmitter of claim 16 wherein a number of possible determined innovation sequences is $2^M$ and the codes in each codebook numbers $2^{M/2}$ when M is an even integer.

21. The transmitter of claim 16 wherein the determined innovation sequences numbers 256 and the codes in each codebook numbers 16.

* * * * *

UNITED STATES PATENT AND TRADEMARK OFFICE

CERTIFICATE OF CORRECTION

PATENT NO. : 6,389,388 B1
DATED : May 14, 2002
INVENTOR(S) : Daniel Lin

It is certified that error appears in the above-identified patent and that said Letters Patent is hereby corrected as shown below:

Column 6,
Line 9, delete "$\perp$T" and insert therefor -- $\psi$ --.
Lines 10 and 44, delete "$\psi$T" and insert therefor -- $\psi$ --.

Column 9,
Line 14, delete "odes" and insert therefor -- codes --.

Signed and Sealed this

Tenth Day of August, 2004

JON W. DUDAS
*Acting Director of the United States Patent and Trademark Office*